US005251892A

United States Patent [19]

No et al.

[11] Patent Number: 5,251,892

[45] Date of Patent: Oct. 12, 1993

[54] METHOD OF AND APPARATUS FOR EJECTING PAPER IN A PRINTING SYSTEM

[75] Inventors: Kwang-ho No; Ki-sun Jang, both of Suwon, Rep. of Korea

[73] Assignee: Samsung Electronics Co., Ltd., Rep. of Korea

[21] Appl. No.: 827,718

[22] Filed: Jan. 29, 1992

[30] Foreign Application Priority Data

Jan. 29, 1991 [KR] Rep. of Korea ..... 91-1515

[51] Int. Cl.[5] ..... B65H 29/00; B65H 29/46

[52] U.S. Cl. ..... 271/184; 271/84; 198/719; 198/747

[58] Field of Search ..... 271/84, 184, 225, 269, 271/271; 198/457, 468.6, 468.11, 719, 747; 74/29, 34, 35; 254/95, 97

[56] References Cited

U.S. PATENT DOCUMENTS

| | | | |
|---|---|---|---|
| 1,427,642 | 8/1922 | Rickard | 254/17 |
| 3,355,168 | 11/1967 | Clausen et al. | 271/84 |
| 4,168,595 | 9/1979 | Pickles et al. | 74/29 X |
| 4,483,530 | 11/1984 | Spencer et al. | 271/184 X |

FOREIGN PATENT DOCUMENTS

| | | | |
|---|---|---|---|
| 11573 | 1/1977 | Japan | 271/84 |
| 189910 | 11/1982 | Japan | 198/797 |
| 203029 | 11/1984 | Japan | 271/225 |
| 258041 | 12/1985 | Japan | 271/184 |
| 215433 | 9/1987 | Japan | 271/84 |
| 1-72174 | 7/1989 | Japan | 271/225 |
| 2-82157 | 11/1990 | Japan | 271/184 |

*Primary Examiner*—Robert P. Olszewski
*Assistant Examiner*—Boris Milef
*Attorney, Agent, or Firm*—Sughrue, Mion, Zinn, Macpeak & Seas

[57] ABSTRACT

A paper ejecting apparatus embodied in a printing system, such as a video color printer, that is constructed to push out or eject a printed sheet of paper. The apparatus includes long guide channels formed in a panel for feeding paper toward an ejecting direction, a pusher movable along the guide channels, a rack gear member connected to the pusher, a guide support member for movably supporting the rack gear member, and a driving source for driving the rack gear member having a pinion driven by the driving source. Also, components are added to the driving source for preventing overload thereof. The operation of the apparatus is smooth, so that the paper is securely ejected without being damaged, and the apparatus is simple in structure and causes little mechanical noise.

11 Claims, 3 Drawing Sheets

METHOD OF AND APPARATUS FOR EJECTING PAPER IN A PRINTING SYSTEM

BACKGROUND OF THE INVENTION

The present invention relates to a method of and apparatus for ejecting paper in printers, copiers and the like.

A conventional paper ejecting apparatus for a video color printer is illustrated in FIG. 1. The printer is a video color printer that is commercially available as Model No. VY-PI manufactured by Hitachi Co., Japan. In the Hitachi apparatus, a printed sheet of paper 11 is transferred between upper and lower panels 1 and 2 by feed rollers 3 and 4, rotating in contact with each other. Thereafter, paper 11 is pushed forward by push arms 5 and 6 between panels 1 and 2, and then is outwardly ejected by exhaust rollers 9 and 10. Push arms 5 and 6 provided with sector gears 51 and 61, respectively, are installed to pivot on axes 52 and 62, respectively, so as to allow sector gears 51 and 61 to rotate while meshed. Also, one push arm 5 is provided with an interlocking pin 53 to be drawn by a spring 7, so that push arms 5 and 6 are operated by the pulling and pushing of interlocking pin 53 by means of a slide member 8 moving in the directions of arrows A. That is, when slide member 8 pushes interlocking pin 53, the gap between push arms 5 and 6 is widened, and as paper 11 is supplied between panels 1 and 2, slide member 8 retreats. According to this operation, the gap between push arms 5 and 6 is narrowed by the restoring strength of spring 7, thus forcing paper 11 out.

In the conventional apparatus thus described the push arms 5 and 6 function as tongs, and work very swiftly due to the resilience of the spring. The apparatus, however, has problems in that the paper, which is thin and flexible, is easily crumpled, jammed, or both, in the interval between the panel and the push arm, thus creating trouble in ejecting the paper. Further, since the traveling distance of the paper pushed by the push arms 5 and 6 is not long enough to completely eject the paper, the exhaust rollers 9 and 10 must be installed to completely eject the paper. As a result, the apparatus is complicated in structure, expensive, and generates considerable noise.

SUMMARY OF THE INVENTION

Therefore, it is the object of the present invention to provide a paper ejecting apparatus in a printing system, wherein a simplified process and structure is employed to smoothly eject a printed sheet of paper without the sheet being damaged or jammed in the printer.

To achieve the above and other objects of the present invention, there is provided a paper ejecting method and apparatus in a system such as a video color printer which includes upper and lower panels spaced apart from each other and feed rollers for transferring a printed sheet of paper from a recording side into the space between upper and lower panels, thereby outwardly ejecting the paper transferred between the upper and lower panels. The apparatus is typically composed of:

long guide channels formed in the lower panel and extending in the ejecting direction of the paper;

a pusher having portions inserted into the guide channels to slide along the guide channels;

a rack gear member connected to and moved together with the pusher;

a guide support member for guiding the movement of the rack gear member; and a driving mechanism for driving the rack gear member with a rotated pinion while being engaged with the rack gear member and driven by a driving source, whereby the printed sheet of paper is ejected by the pusher after being placed in front of the pusher.

BRIEF DESCRIPTION OF THE DRAWINGS

Other objects and advantages of the present invention will be apparent from the detailed description below with reference to the accompanying drawings, in which.

DETAILED DESCRIPTION OF THE PREFERRED EMBODIMENT OF THE INVENTION

Figure 2:
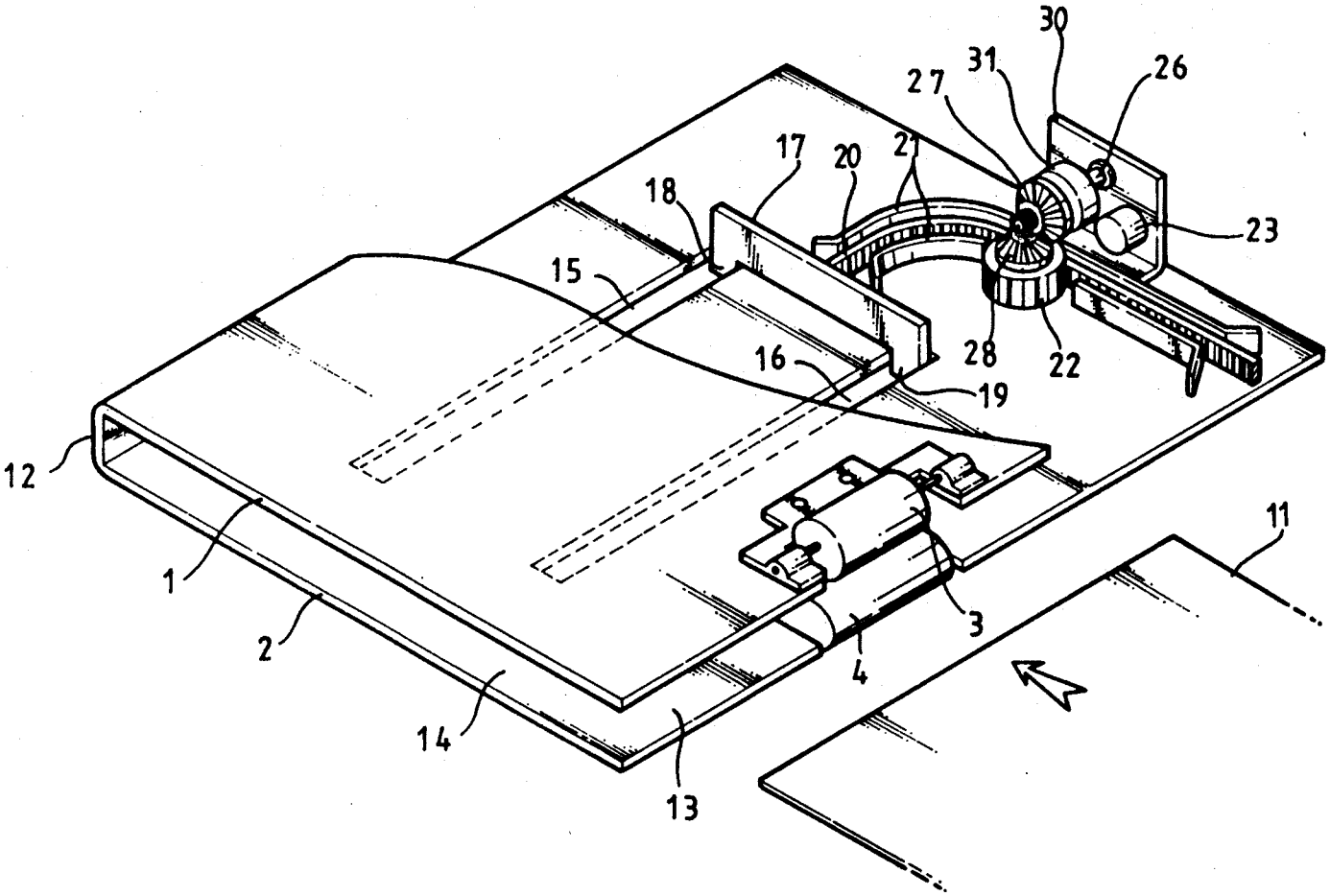
FIG. 2 is a perspective view of a paper ejecting apparatus in a video color printer according to the present invention.

Referring to FIG. 2, a paper ejecting apparatus according to the present invention is explained as follows as embodied in a video color printer.

Upper and lower panels 1 and 2 spaced apart from each other are formed as one body by an extension 12, having an inlet 13 for feeding paper from one side and an outlet 14 in the front for outputting the paper. A pair of feed rollers 3 and 4 installed on inlet 13 is used to transfer a sheet of paper 11 between panels 1 and 2; preferably the paper has been exposed to a printing process (printed) by a recorder of the printer (not shown). A pair of parallel guide channels 15 and 16 extending toward outlet 14 are formed in lower panel 2.

A pusher 17 is installed such that ends 18 and 19 are together inserted into guide channels 15 and 16, respectively, thereby allowing movement along the guide channels 15 and 16. Pusher 17 is first positioned at the back ends of guide channels 15 and 16 by a rack gear member and an associated driving unit which will be described later. After paper 11 is transferred by feed rollers 3 and 4, pusher 17 is moved forward toward outlet 14 so that paper 11 is completely ejected through the outlet 14.

A rack gear member 20 is connected to the reverse side of pusher 17. Rack gear member 20 is supported by a guide support member 21 formed on lower panel 2, to be moved along guide support member 21. Rack gear member 20 is formed of a flexible material, and as seen in the drawing, guide support member 21 is arc-shaped, so that together members 20 and 21 occupy only a small portion of the surface space between panels 1 and 2.

A pinion 22 protrudes through one part of guide support member 21 to be engaged with rack gear member 20 within guide support member 21.

Figure 3:
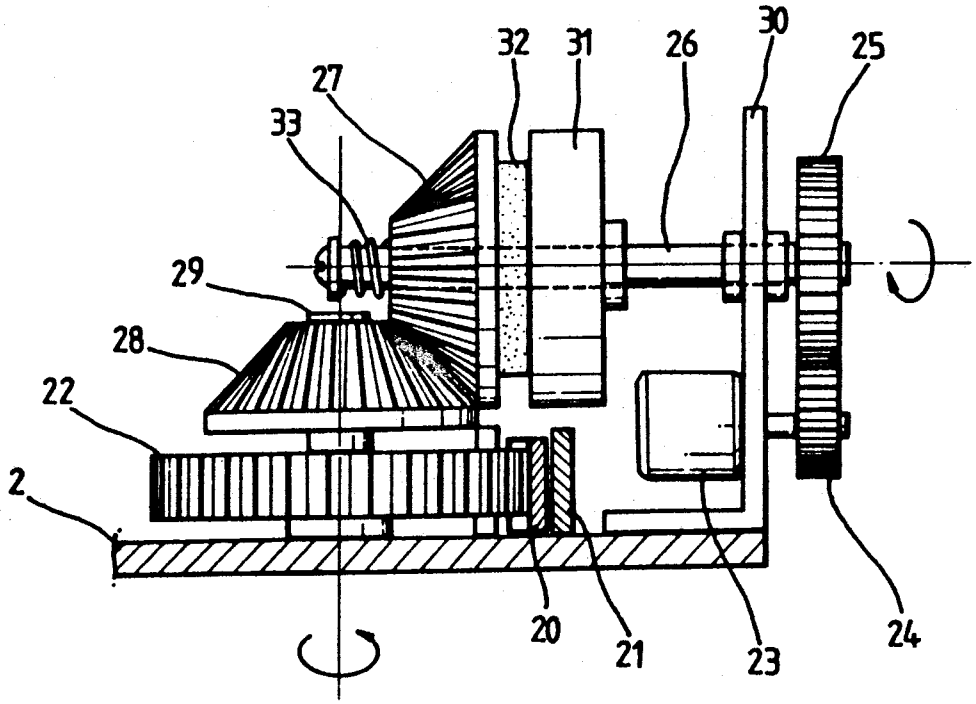
FIG. 3 is a sectional view showing the detailed structure of a driving unit of the paper ejecting apparatus in the video color printer of FIG. 2 according to the present invention.

As illustrated in FIG. 3, a driving unit has a driving source that includes motor 23 for driving rack gear member 20 along with pinion 22. A driving gear 24 on the shaft of motor 23 is engaged with transmission gear 25. A pair of bevel gears 27 and 28, which are engaged with each other, are installed on a transmission shaft 26 of transmission gear 25 and a driven shaft 29, respectively. The transmission shaft 26 is supported by a separate bracket 30 installed on lower panel 2, and driven shaft 29 is directly supported by lower panel 2. Together with bevel gear 28 pinion 22 is installed on driven shaft 29. In order to prevent overload operation, both a friction disc 31, which is provided with felt 32 in contact with one side of bevel gear 27, and also a spring 33, which is used to bias bevel gear 27 toward friction disc 31, are added onto transmission shaft 26. Bevel gear 27 can be slidably rotated around transmission shaft 26, and friction disc 30 is secured to transmission shaft 26. Motor 23 is capable of rotating in both forward and reverse directions and is capable of being timely controlled in accordance with a control circuit (not shown).

The operation of the paper ejecting apparatus according to the present invention thus constructed is described below.

The apparatus shown in FIG. 2 is a part of a video color printer, e.g., of a thermal transfer printing system, in which the recorder of the printer is positioned toward inlet 13 of panels 1 and 2. In accordance with the conventional method, a picture is recorded on paper 11 by a thermal transfer head in the recorder (not shown). After completing the printing process, a printed sheet of paper 11 is transferred toward inlet 13 of panels 1 and 2, and is successively input between panels 1 and 2 by feed rollers 3 and 4 installed at inlet 13. At this time, since pusher 17 is positioned at the back ends of guide channels 15 and 16, paper 11 is placed in front of pusher 17.

After placing the sheet of paper 11 in front of pusher 17, motor 23 begins operating. When motor 23 is operated, transmission shaft 26 is rotated by the rotations of gears 24 and 25, and driven shaft 29 is rotated by the rotations of bevel gears 27 and 28. Upon the rotation of driven shaft 29, pinion 22 is rotated to set rack gear member 20 in motion. By this operation of rack gear member 20, and while sliding toward outlet 14 along guide channels 15 and 16, pusher 17 forces paper 11 out of outlet 14. Accordingly, paper 11 is ejected through outlet 14 by pusher 17.

Overload due to various operation conditions restrains driven shaft 29, and when the restraining force is greater than the friction which is generated by the pressing of spring 33, between bevel gear 27 and felt 32 of friction disc 31, then bevel gears 27 and 28, driven shaft 29, and pinion 22 will not rotate due to slippage between bevel gear 27 and felt 32. This phenomenon appears also as motor 23 continues to rotate when pusher 17 reaches the far end of guide channels 15 and 16; thus, accurate timing is not required for controlling motor 23.

After ejecting paper 11, motor 23 is controlled to be rotated in the reverse direction, and pusher 17 retreats to its initial position.

Figure 1:
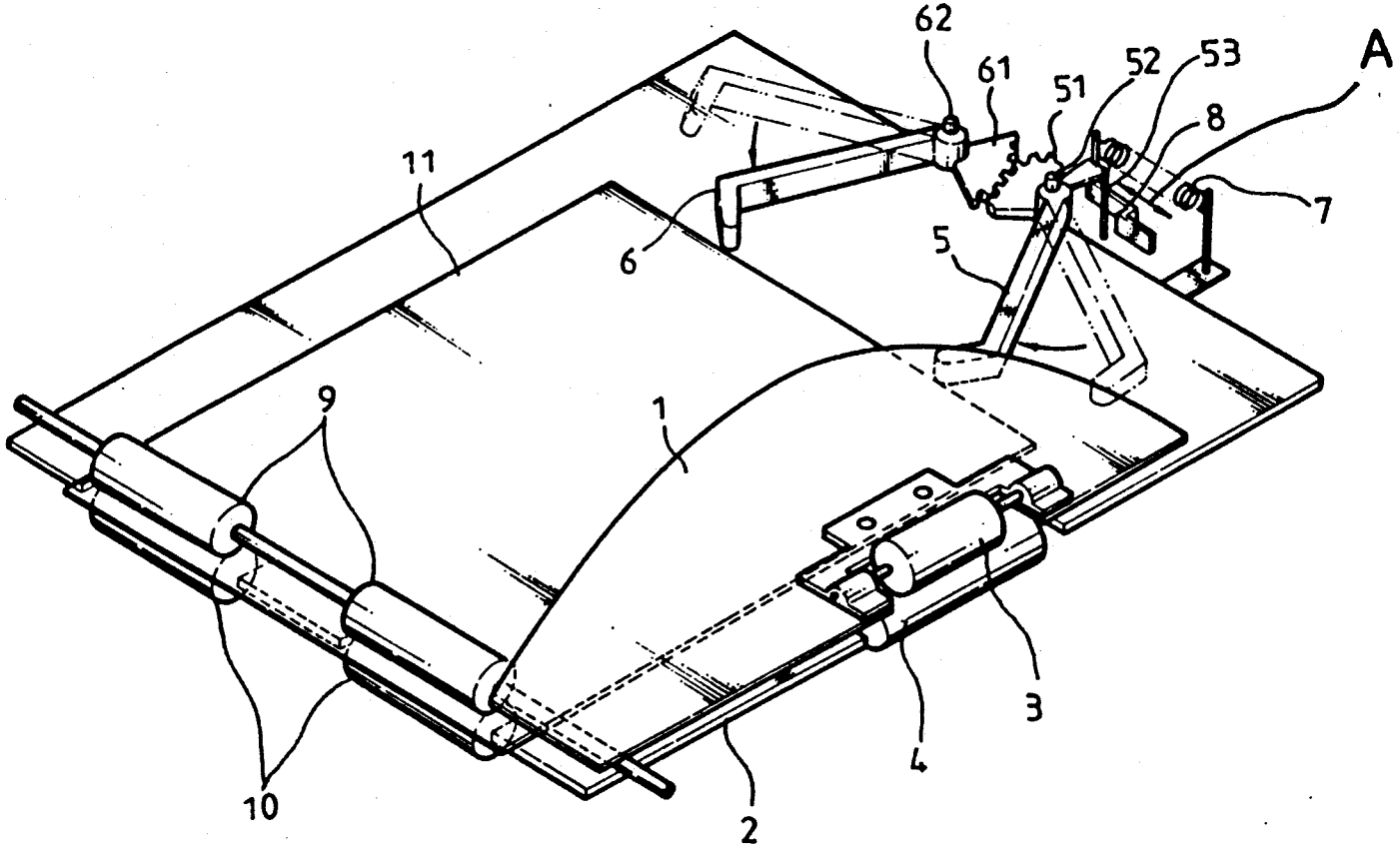
FIG. 1 (PRIOR ART)
FIG. 1 is a perspective view of a paper ejecting apparatus in a conventional video color printer.

In the above-described paper ejecting apparatus according to the present invention, since the rotation movement is converted into linear motion to push out the paper, the ejection of the paper is smooth. Therefore, the mechanical noise is low, and the paper is not crumpled or jammed between the pusher and panel, thus the successful ejecting operation of the paper is ensured. In addition, in the apparatus of the present invention, the paper is ejected by the sliding movement of the pusher, so that the traveling distance of the pusher can be set to an adequate length, which in turn enables troublefree ejection of the paper solely by the movement of the pusher without requiring the conventional ejecting rollers 9 and 10 shown in FIG. 1. As a result, the apparatus of the present invention is of good quality and inexpensive as compared with the conventional apparatus.

While a preferred embodiment of the invention has been described using specific terms in particular application within a video color printer, such description is for illustrative purposes only, and it is to be understood that changes and variations may be made without departing form the spirit or scope of the following claims.

What is claimed is:

1. A paper ejecting apparatus, which includes upper and lower panels spaced apart from each other and feed rollers for transferring a sheet of paper into the space between said upper and lower panels, for outwardly ejecting the paper transferred between said panels, the apparatus comprising:

guide channels formed in said lower panel and extending in an ejecting direction;

a pusher having portions slidably engaged with said guide channels;

a flexible rack gear member connected to said pusher;

an arcuate guide support member for guiding movement of said rack gear member through an arcuate path; and a driving source for rotatably driving said rack gear member together with said pusher so that the sheet of paper is ejected from the apparatus.

2. A paper ejecting apparatus as claimed in claim 1, wherein said guide channels are formed in at least two portions parallel to each other, and said pusher has portions inserted into each of said at least two guide channels.

3. A paper ejecting apparatus as claimed in claim 1, wherein said driving source comprises:

a motor;

a rotatable pinion operatively engaged with said rack member;

a driving gear at the side of said motor and a transmission gear engaged with said driving gear; and a pair of bevel gears engaged with each other and respectively installed on a transmission shaft of said transmission gear and on a driven shaft on which said pinion is supported.

4. A method of ejecting paper comprising the steps of:

transferring a sheet of paper into contact with a pusher member;

guiding the pusher member in an ejecting direction;

moving a flexible rack gear member connected to the pusher member through an arcuate path;

rotating a pinion engaged with the rack gear member so as to drive the rack gear member together with the pusher member; and driving the pusher member in the ejecting direction so that the sheet of paper is ejected in the ejecting direction.

5. A paper ejecting apparatus, which includes upper and lower panels spaced apart from each other and feed rollers for transferring a sheet of paper into the space between said upper and lower panels, for outwardly ejecting the paper transferred between said panels, the apparatus comprising:

a guide formed in said lower panel, said guide extending in an ejecting direction;

a pusher slidably engaged with said guide;

a rack gear member connected to said pusher;

a guide support member engaged with said rack gear member so as to guide movement of said rack gear member;

a driving source engaged with said rack gear member so as impart motion to said rack gear member and said pusher so that the sheet of paper is ejected from the apparatus, said driving source comprising a motor, a driving gear mounted on a shaft of said motor, a transmission gear mounted on a transmission shaft and engaged with said driving gear, first and second bevel gears engaged with each other and respectively mounted on said transmission shaft and on a driven shaft, and a rotatable pinion mounted on said driven shaft, said pinion being engaged with said rack gear member.

6. A paper ejecting apparatus as claimed in claim 5, wherein said transmission shaft has a friction disc provided with felt thereon, said felt being in contact with one side of said first bevel gear, and a spring for pressing said first bevel gear toward said friction disc said first bevel gear is rotated along with said friction disc due to friction therebetween.

7. A method of ejecting paper from a video color printer comprising the steps of:

transferring a sheet of paper from a recorder section of said printer into contact with a pusher member;

moving a flexible rack gear member, which is connected to said pusher member, through an arcuate path by rotating a pinion engaged with said rack gear member and guiding said rack gear member through said arcuate path;

guiding said pusher member in an ejecting direction.

8. A material ejecting apparatus comprising:

a pusher means for pushing a sheet of material in an ejection direction;

driving means for driving said pusher means so that the sheet of material is pushed in an ejection direction, said driving means comprising a motor operatively coupled to a transmission gear which is mounted on a transmission shaft, a first bevel gear rotatably mounted on said transmission shaft, a friction disc mounted on said transmission shaft at a position between said first bevel gear and said transmission gear, means for pressing said first bevel gear against said friction disc, a second bevel gear mounted on a drive shaft and being operatively engaged with said first bevel gear, a pinion mounted on said drive shaft; and rack gear means having a front-end portion connected to one side of said pusher means, and being operatively engaged with said pinion so as to cause said pusher means to move in said ejection direction in response to activation of said motor.

9. A material ejecting apparatus comprising:

pusher means for pushing a sheet of material in an ejection direction;

a U-shaped panel having upper and lower portions, said pusher means being supported by said U-shaped panel;

guide channel means formed in said lower portion and extending in the ejection direction for guiding movement of said pusher means as it pushes the sheet of material in the ejection direction;

driving means for rotatably driving said pusher means so that the sheet of material is pushed towards the ejection direction, said driving means includes a pinion that rotates around an axis of a drive shaft; and rack gear means, having a front-end portion connected to one side of said pusher means, said pinion being engaged with said rack gear means to cause the complete ejection of the sheet of material when a back-end portion of said rack gear means is engaged with said pinion, said rack gear means being formed from a flexible material and extending in an arcuate path between said driving means, and said pusher means;

guide support means for guiding movement of said rack gear means through said arcuate path as said rack gear means is driven by said driving means.

10. A material ejecting apparatus comprising:

pusher means for pushing a sheet of material in an ejection direction;

driving means for rotatably driving said pusher means so that the sheet of material is pushed towards the ejection direction, said driving means comprising, a motor for driving a transmission gear which is operatively coupled thereto, a first bevel gear mounted on a transmission shaft which is rotated by the transmission gear, pressing means for pressing said bevel gear towards a friction disc, a second bevel gear operatively engaged with said first bevel gear and mounted on a drive shaft, and a pinion mounted on said drive shaft so as to rotate in response to rotation of said first bevel gear, rotation of said first bevel gear being terminated when a restraining force inhibiting rotation of the drive shaft is greater than the friction force between said first bevel gear and said friction disc;

rack gear means having a front-end portion connected to one side of said pusher means, said rack gear means being operatively engaged with said pinion so as to cause the complete ejection of the sheet of material when a back-end portion of said rack gear means is engaged with said pinion, said rack gear means being formed from a flexible material and extending in an arcuate path between said driving means and said pusher means.

11. The material ejecting apparatus of claim 10, wherein the material is a sheet of paper which has been transferred from a recorder of a video color printer.

* * * * *